US006010439A

United States Patent [19]

Bullard, Jr.

[11] Patent Number: 6,010,439

[45] Date of Patent: Jan. 4, 2000

[54] CHEST EXERCISE APPARATUS

[76] Inventor: Eston Bullard, Jr., 2412 Quail Ave., Jacksonville, Fla. 32218

[21] Appl. No.: 09/326,946

[22] Filed: Jun. 7, 1999

[51] Int. Cl.[7] ..... A63B 21/075

[52] U.S. Cl. ..... 482/106

[58] Field of Search ..... 482/50, 106–108, 482/110, 139; D21/679, 681

[56] References Cited

U.S. PATENT DOCUMENTS 4,360,198 11/1982 Waulters ..... 482/106

4,832,334 5/1989 Mullen ..... 482/106

5,836,858 11/1998 Sharff ..... 482/106

*Primary Examiner*—John Mulcahy

*Attorney, Agent, or Firm*—Steven R. Scott

[57] ABSTRACT

Chest exercise apparatus in the form of a bench press bar which allows additional stretching of the chest muscles via the provision of an elevated chest section such that the hands of the user can be brought below the chest when doing bench presses and which, in its preferred embodiments, also includes (i) a mechanism for adjusting the height of said chest section and (ii) spotter handles.

14 Claims, 4 Drawing Sheets

CHEST EXERCISE APPARATUS

BACKGROUND

1. Field of the Invention

The instant invention relates to exercise devices generally and more particularly, to exercise devices focused on the development of the chest muscles. In its preferred embodiments, it takes the form of improved bench press bars. The structure of said devices is designed to allow for three (3) inches or more of additional stretch for the upper chest muscles as well as to provide convenient "spotter" handles for those assisting the user of the device.

2. Prior Art in the Field

Generally bench presses are used for the development of superior chest muscles. When exercising, the conventional bench press bar, which is straight, only allows the hands to go to the chest depth level when the bar is lowered to its fullest extent for the upward push. It does not allow a full stretch and extension of the chest muscles. Moreover, it is not well adapted for use by athletes seeking maximum muscular development through exercise to the point of exhaustion. In such exercise regimens, the athlete seeks to exercise to the point where no further muscular exertion is possible. To reach this point, it is generally necessary to have a "spotter" who not only can serve to assist in the completion of the last bench press, but who can "rescue" the athlete from possibly being penned under a bench press bar that he/she no longer has the strength to move. To this point, there have been no bench press bars that are adapted for this purpose by the provision of convenient handles for the use of the spotter assisting the athlete using the bar.

SUMMARY AND OBJECTS OF THE INVENTION

It is an objective of the present invention to provide a bench press bar that allows for full exercise of the upper chest muscles across the full range of their extension/contraction and that is provided with convenient handles for the use of a spotter assisting the athlete utilizing the bar. These objects are accomplished by the provision of an improved bench press bar. The bench press bar taught herein varies from the standard bench press bar design in that it (i) possesses a raised portion adapted for positioning across the user's chest and (ii) possesses handles conveniently located for the use of a spotter. The raised portion of the bench press bar allows the hand grip portion to be lowered in relation thereto, creating greater extension of the chest muscles and lowering the center of gravity (for improved balance). In its preferred embodiment, the portion of the bar on which free weights are attached/suspended is lower still, creating a still lower center of gravity and even greater balance. Overall, this technically advanced, unique configuration permits the hands to go three inches (3") or more below the chest depth level, thereby allowing an extra available three inch stretch of the upper chest muscles. Moreover, the "knurled" grips of the bench press bar described herein are strategically positioned for a perfectly aligned grip and better balance, thereby fostering safer and more comfortable exercising. In addition, it is provided with spotter handles to further assist in its efficient utilization by athletes seeking to maximize the benefit offered by its use by exercising to the point of muscular exhaustion. Finally, in its most advanced configurations, the depth below chest depth level (and degree of upper chest muscle stretch) is adjustable by the user.

DETAILED DESCRIPTION OF THE PREFERRED EMBODIMENTS

Figure 1:
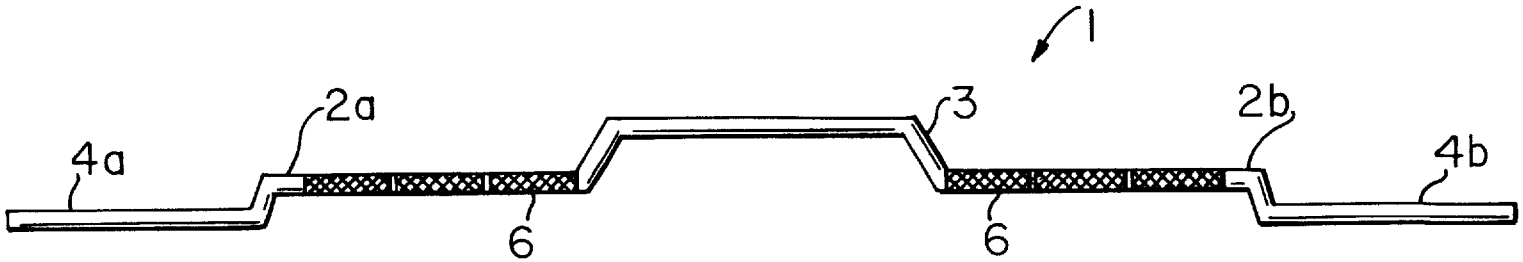
FIG. 1 provides a first view of a basic embodiment of an improved bench press bar in accordance with the teachings of this invention, which embodiment does not include special spotter handles such as those included in the preferred embodiments.
Figure 2:
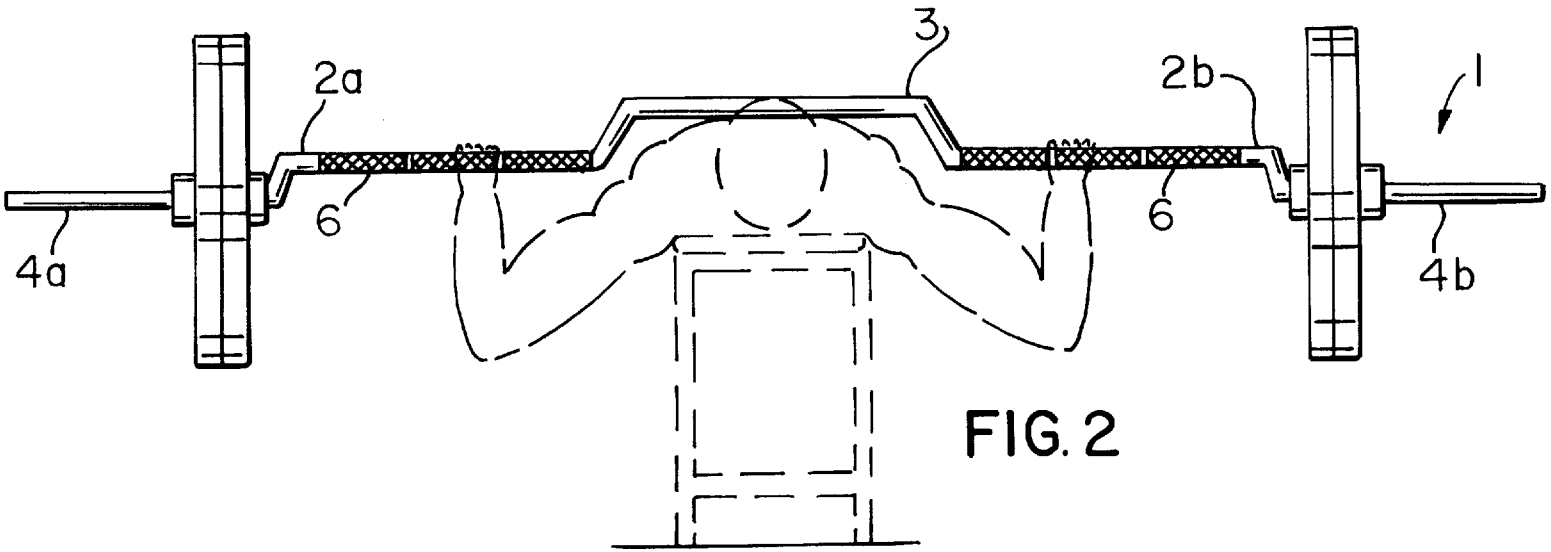
FIG. 2 provides a further view of the improved bench press bar of FIG. 1, illustrating its mode of use for exercise purposes.

A basic embodiment of a bench press bar according to the teachings of this invention is illustrated in FIGS. 1 and 2. As will be noted upon review of said drawings, the basic embodiment of the bench press bar 1 taught herein is provided with a first generally linear member 2*a* and a second generally linear member 2*b*, which are aligned and are adapted for use as human hand grips. A generally linear connective member 3 is (i) intermediate and connected to said first generally linear member 2*a* and said second generally linear member 2*b*, (ii) lies in a plane containing said first generally linear member 2*a* and said second generally linear member 2*b*, and (iii) is parallel to said first generally linear member 2*a* and said second generally linear member 2*b*. It will also be noted that the generally linear connective member 3 is not aligned with said first generally linear member 2*a* and said second generally linear member 2*b*, but is displaced upward therefrom by approximately three inches (3"). (This distance has been found to provide the optimum degree of "stretch" for most users). The first generally linear member 2*a* and the second generally linear member 2*b* could be extended to serve as weight bearing members. However, as illustrated in all of the drawing figures, it is preferable to provide a third generally linear member 4*a* and a fourth generally linear member 4*b* for this purpose. These members are adapted for use as barbell weight holding members, and are connected to said first generally linear member 2*a* and said second generally linear member 2*b* for this purpose.

As will be further noted with regard to the embodiments illustrated, said third generally linear member 4*a* and said fourth generally linear member 4*b*—(i) are aligned with each other and not with said first generally linear member 2*a* and said second generally linear member 2*b*, (ii) are parallel to said first generally linear member 2*a* and said second generally linear member 2*b*, (iii) lie in a plane containing said first generally linear member 2*a*, said second generally linear member 2*b*, and said generally linear connective member 3, and (iv) lie on the opposite side of a line containing said first generally linear member 2*a* and said second generally linear member 2*b* from said generally linear connective member 3. Further, the distance between (i) the line containing said first generally linear member 2*a* and said second generally linear member 2*b* and (ii) the line containing said third generally linear member 4*a* and said fourth generally linear member 4*b* is approximately 2 inches (2"). (These dimensions have been found to provide optimum stability to the configuration).

First generally linear member 2*a* and second generally linear member 2*b* each have a length of approximately 18 and ¼ inches, said generally linear connective member 3 has a length of approximately 16 and ¼ inches, and said third generally linear member 4*a* and fourth generally linear member 4*b* each have a length of approximately 15 inches with the total length of the bench press bar 1 being approximately seven feet and three and three eighths inches (7'3 & ⅜"). One inch (1") steel round stock may advantageously be utilized for production of the bench press bar 1 and the addition of knurled grips 6 to the first generally linear member 2*a* and the second generally linear member 2*b*, to facilitate their use as hand grips is also preferred. The knurled grips 6 (only two of which are denoted to avoid overcrowding of the drawing figures) permit a grip from the width of approximately 22" to approximately 36" and are strategically positioned for perfectly aligned grips and balance. (Once again, the foregoing dimensions represent the optimum determined by the inventor in terms of stability, versatility and ease of use).

Figure 3:
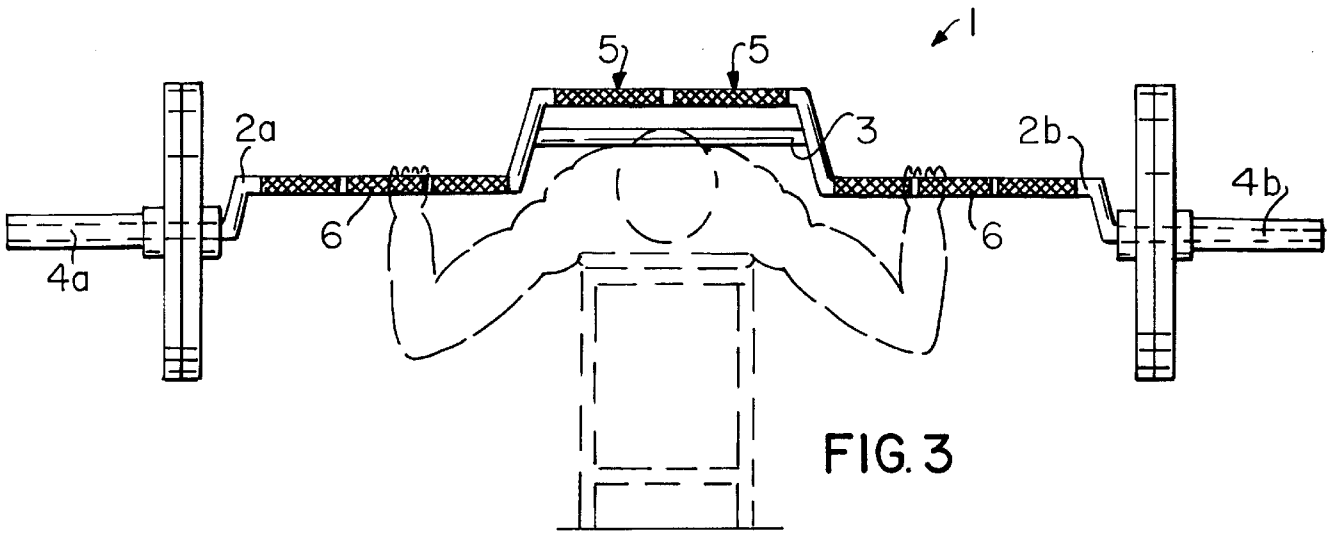
FIG. 3 provides a view of a first preferred embodiment of the improved bench press bar in accordance with the teachings of this invention, illustrating its mode of use for exercise purposes.
Figure 4:
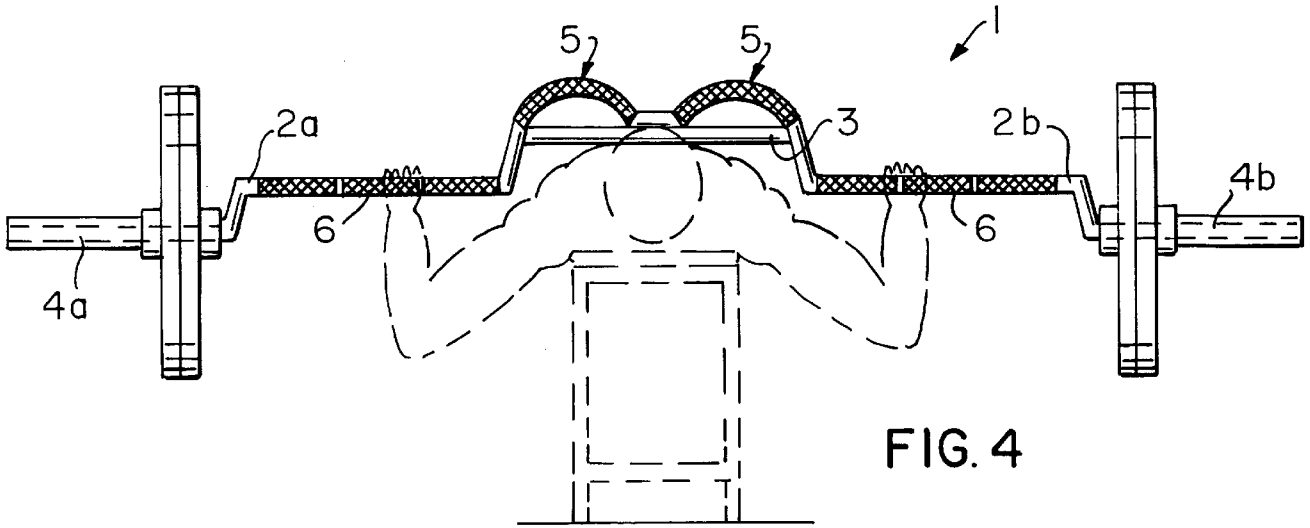
FIG. 4 provides a view of a second preferred embodiment of the improved bench press bar in accordance with the teachings of this invention.
Figure 5:
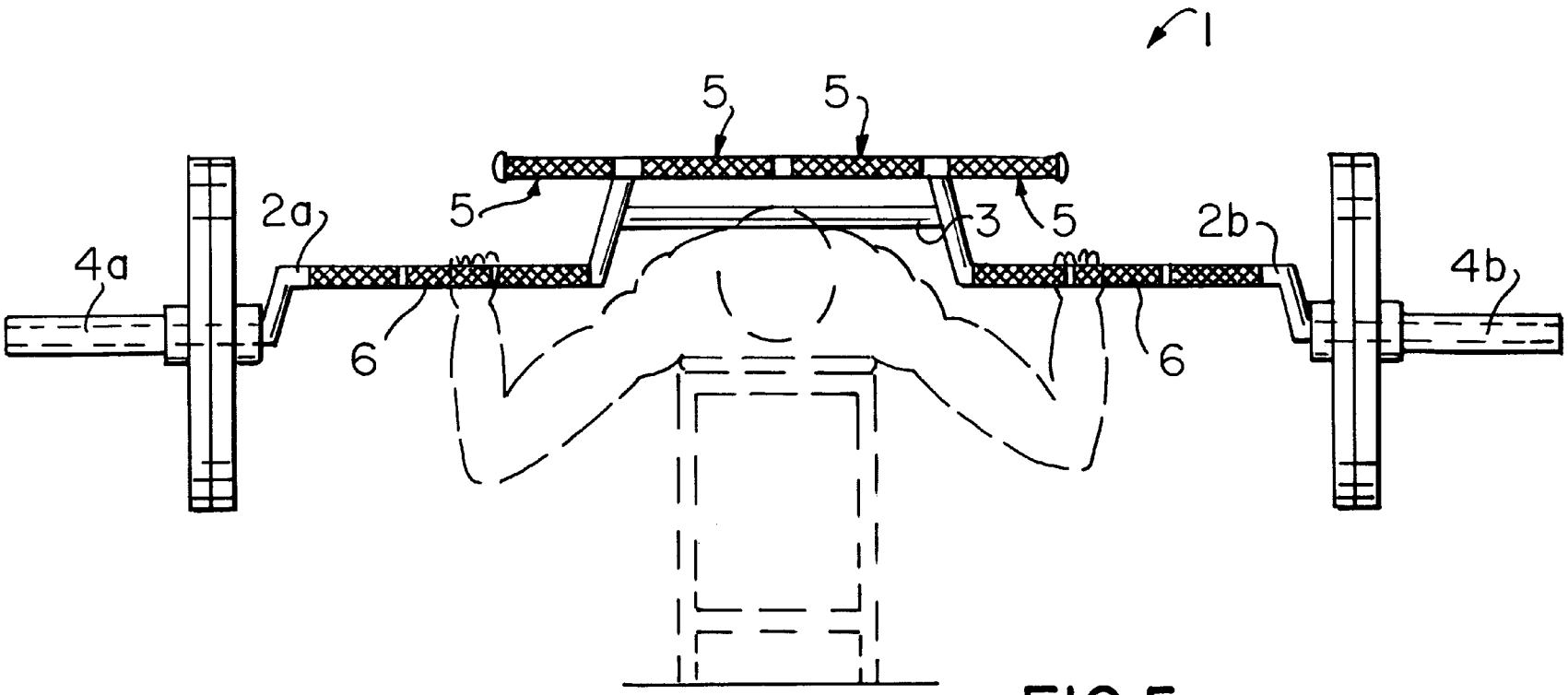
FIG. 5 provides a view of a third preferred embodiment of the improved bench press bar in accordance with the teachings of this invention.
Figure 6:
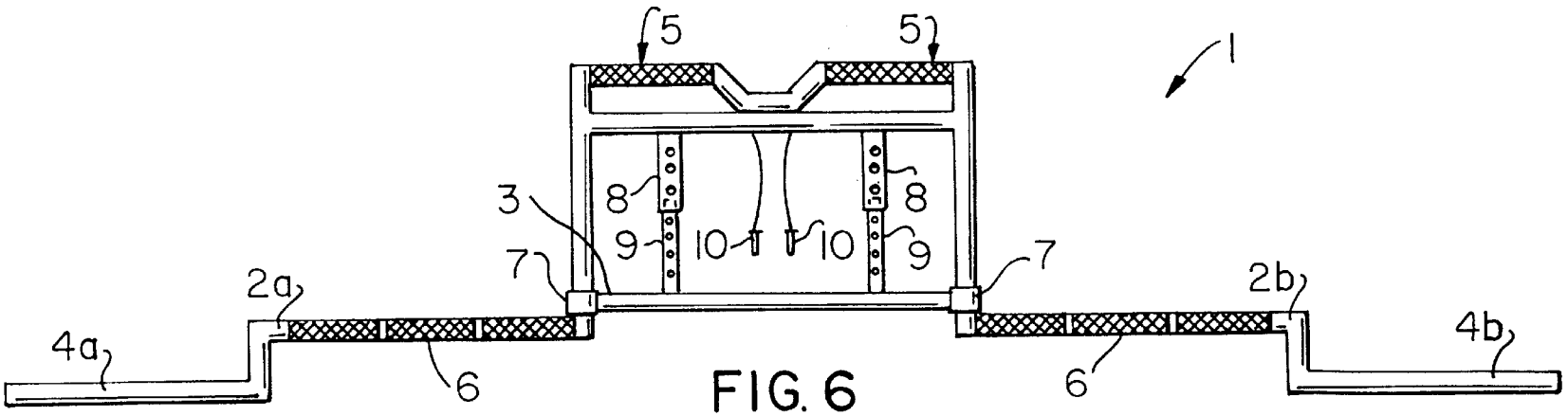
FIG. 6 provides a view of a fourth preferred embodiment of the improved bench press bar in accordance with the teachings of this invention.
Figure 7:
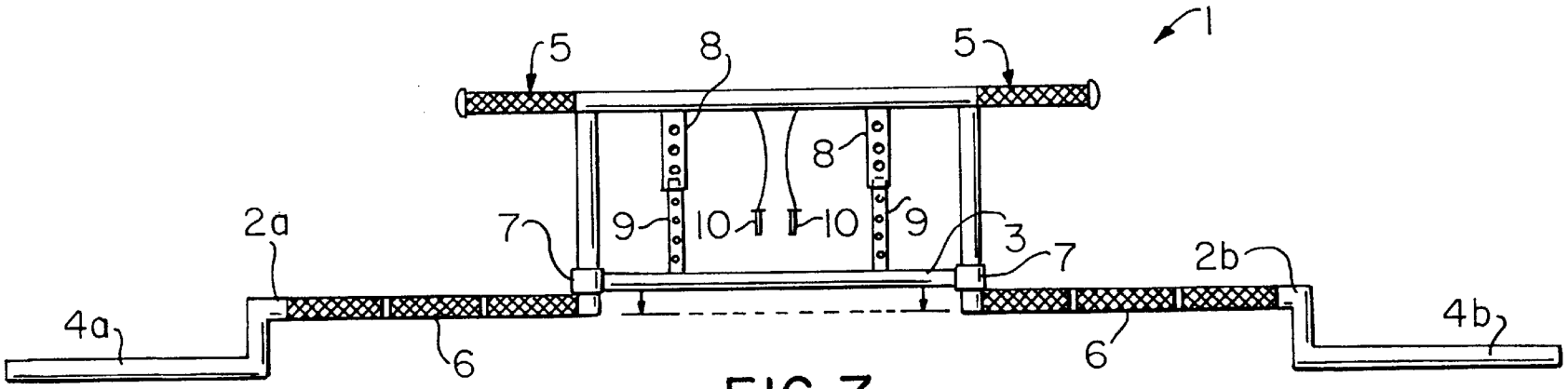
FIG. 7 provides a view of a fifth preferred embodiment of the improved bench press bar in accordance with the teachings of this invention.

The operation of the embodiments illustrated may best be understood by reference to FIGS. 2 and 3, where a user is illustrated in a supine position on a bench press bench utilizing the bench press bar 1 produced in accordance with the teachings of this invention. It should further be noted from the aforesaid illustration that the dimensions chosen allow the bench press bar produced in accordance herewith to fit all pro-weight bench racks.

The embodiments illustrated in FIGS. 3 through 7 differs from those illustrated in FIGS. 1 and 2 in two important particulars. First, all of the preferred embodiments are provided with spotter handles (denoted generally by arrows 5). Second, in the embodiments illustrated in FIGS. 6 and 7 the positioning of the generally linear connective member 3 is adjustable, providing greater versatility to the user. Sleeves 7 makes vertical movement of the generally linear connective member 3, while the combination of adjustment sleeves 8 with vertical rods 9 and pins 10 make it possible to fix it in a variety of positions for exercise purposes.

Numerous additional variations are possible in the design and use of the chest exercise apparatus described herein without exceeding the ambit of the inventive concept disclosed herein, as more particularly and specifically set forth in the claims that follow.

I claim:

1. A chest exercise apparatus, comprising:

(a) a first generally linear member, which first generally linear member is adapted for use as a human hand grip;

(b) a second generally linear member, which second generally linear member is adapted for use as a human hand grip and is aligned with and spaced apart from said first generally linear member for gripping in a bench press exercise;

(c) a generally linear connective member intermediate and connected to said first generally linear member and said second generally linear member, which generally linear connective member lies in a plane containing said first generally linear member and said second generally linear member, is parallel to said first generally linear member and said second generally linear member, but is not aligned with said first generally linear member and said second generally linear member, forming a raised portion adapted for positioning across a user's chest;

(d) a third generally linear member, which third generally linear member is adapted for use as a barbell weight holding member and is connected to said first generally linear member opposite said generally linear connective member;

(e) a fourth generally linear member, which fourth generally linear member is adapted for use as a barbell weight holding member and is connected to said second generally linear member opposite said generally linear connective member;

(f) at least one spotter handle, which said at least one spotter handle is adapted for use as a human hand grip and is connected to said generally linear connective member opposite said first generally linear member and said second generally linear member.

2. A chest exercise apparatus, as described in claim 1, further comprising a mechanism by which a user may vary the distance between a line containing said generally linear connective member and a line containing said first generally linear member and said second generally linear member.

3. A chest exercise apparatus, as described in claim 1, wherein the distance between a line containing said generally linear connective member and a line containing said first generally linear member and said second generally linear member is approximately 3 inches.

4. A chest exercise apparatus, as described in claim 3, wherein the distance between a line containing said first generally linear member and said second generally linear member and a line containing said third generally linear member and said fourth generally linear member is approximately 2 inches.

5. A chest exercise apparatus, as described in claim 4, further comprising a mechanism by which a user may vary the distance between a line containing said generally linear connective member and a line containing said first generally linear member and said second generally linear member.

6. A chest exercise apparatus, as described in claim 1, wherein said third generally linear member and said fourth generally linear member (i) are aligned with each other and not with said first generally linear member and said second generally linear member, (ii) are parallel to said first generally linear member and said second generally linear member, (iii) lie in a plane containing said first generally linear member, said second generally linear member, and said generally linear connective member, and (iv) lie on the opposite side of a line containing said first generally linear member and said second generally linear member from said generally linear connective member.

7. A chest exercise apparatus, as described in claim 6, wherein the distance between a line containing said generally linear connective member and a line containing said first generally linear member and said second generally linear member is approximately 3 inches.

8. A chest exercise apparatus, as described in claim 7, wherein the distance between a line containing said first generally linear member and said second generally linear member and a line containing said third generally linear member and said fourth generally linear member is approximately 2 inches.

9. A chest exercise apparatus, as described in claim 8, wherein said first generally linear member and said second generally linear member each have a length of approximately 18 and ¼ inches and said generally linear connective member has a length of approximately 16 and ¼ inches.

10. A chest exercise apparatus, as described in claim 9, further comprising a mechanism by which a user may vary the distance between a line containing said generally linear connective member and a line containing said first generally linear member and said second generally linear member.

11. A chest exercise apparatus, as described in claim 8, further comprising a mechanism by which a user may vary the distance between a line containing said generally linear connective member and a line containing said first generally linear member and said second generally linear member.

12. A chest exercise apparatus, as described in claim 6, further comprising a mechanism by which a user may vary the distance between a line containing said generally linear connective member and a line containing said first generally linear member and said second generally linear member.

13. A chest exercise apparatus, as described in claim 6, wherein the distance between a line containing said first generally linear member and said second generally linear member and a line containing said third generally linear member and said fourth generally linear member is approximately 2 inches.

14. A chest exercise apparatus, as described in claim 13, further comprising a mechanism by which a user may vary the distance between a line containing said generally linear connective member and a line containing said first generally linear member and said second generally linear member.

* * * * *